United States Patent [19]

Clements et al.

[11] Patent Number: 4,546,740

[45] Date of Patent: Oct. 15, 1985

[54] IGNITION SOURCE FOR INTERNAL COMBUSTION ENGINE

[75] Inventors: Reginald M. Clements; John D. Ridley; Philip L. Pitt, all of Victoria, Canada

[73] Assignee: University of Victoria, Victoria, Canada

[21] Appl. No.: 508,512

[22] Filed: Jun. 28, 1983

[30] Foreign Application Priority Data

Apr. 11, 1983 [CA] Canada ..... 425623

[51] Int. Cl.[4] ..... F02D 3/00; F02B 19/10; F02B 45/08

[52] U.S. Cl. ..... 123/304; 123/297; 123/143 B; 123/305

[58] Field of Search ..... 123/297, 304, 151, 152, 123/169 V, 169 EL, 406, 143 B

[56] References Cited

U.S. PATENT DOCUMENTS

| | | | |
|---|---|---|---|
| Re. 29,978 | 5/1979 | Leshner et al. | 123/297 |
| 1,373,498 | 4/1921 | Gaff | 123/297 |
| 2,692,587 | 10/1954 | Barber | 123/304 |
| 3,081,758 | 3/1963 | May | 123/297 |
| 3,107,658 | 10/1963 | Meurer . | |
| 3,534,714 | 10/1970 | Urlaub . | |
| 4,041,922 | 8/1977 | Abe et al. . | |
| 4,091,774 | 5/1978 | Kamiya . | |
| 4,095,580 | 6/1978 | Murray et al. | 123/297 |
| 4,111,178 | 9/1978 | Casey | 123/152 |
| 4,124,003 | 11/1978 | Abe et al. . | |
| 4,133,322 | 1/1979 | Nakamura et al. . | |
| 4,164,912 | 8/1979 | Beyler . | |
| 4,176,649 | 12/1979 | Karlovitz . | |
| 4,202,307 | 5/1980 | Imamura | 123/151 |
| 4,219,001 | 8/1980 | Kumagagai et al. . | |
| 4,317,068 | 2/1982 | Ward et al. . | |
| 4,370,958 | 2/1983 | Pischinger et al. | 123/304 |
| 4,434,753 | 3/1984 | Makainakano et al. | 123/143 B |
| 4,463,719 | 8/1984 | Pischinger et al. | 123/304 |

FOREIGN PATENT DOCUMENTS

| | | | |
|---|---|---|---|
| 537727 | 3/1957 | Canada . | |
| 565196 | 10/1958 | Canada . | |
| 588190 | 12/1959 | Canada . | |
| 848750 | 8/1970 | Canada . | |
| 869305 | 4/1971 | Canada . | |
| 887977 | 12/1971 | Canada . | |
| 981998 | 1/1976 | Canada . | |
| 994627 | 8/1976 | Canada . | |
| 1020423 | 11/1977 | Canada . | |
| 1044973 | 12/1978 | Canada . | |
| 1092458 | 12/1980 | Canada . | |
| 2304779 | 10/1976 | France | 123/297 |

*Primary Examiner*—Raymond A. Nelli

*Attorney, Agent, or Firm*—Birch, Stewart, Kolasch & Birch

[57] ABSTRACT

An improved ignition system is provided for an internal combustion engine having a combustion chamber and a conventional carburetor system, a conventional fuel injection system or a conventional gas mixing system, for feeding an ambient combustible fuel-air mixture to the combustion chamber. In this system, a high speed injector is fed with a gaseous fuel between a spark gap provided by a spark electrode. The spark electrode projects a predetermined distance into the combustion chamber so that the axis of the injector nozzle passes through the spark gap. A puff in the form of a short, abrupt blast of the gaseous fuel is expelled across the spark to produce a well-defined turbulent plume of the injected gaseous fuel. The time and duration of the electric spark and the fast-acting valve actuator controls the length of time it takes to open the fast-acting valve and the length of time the fast-acting valve remains open. The electric spark occurs after an appropriate predetermined time after the opening of the fast-acting valve, when the gaseous fuel plume in the vicinity of the spark electrode. Then, the ambient fuel-air mixture and the injected gaseous fuel in the combustion chamber are simultaneously ignited. A clear improvement in both ignition and combustion of lean fuel mixtures is thus provided.

7 Claims, 1 Drawing Figure

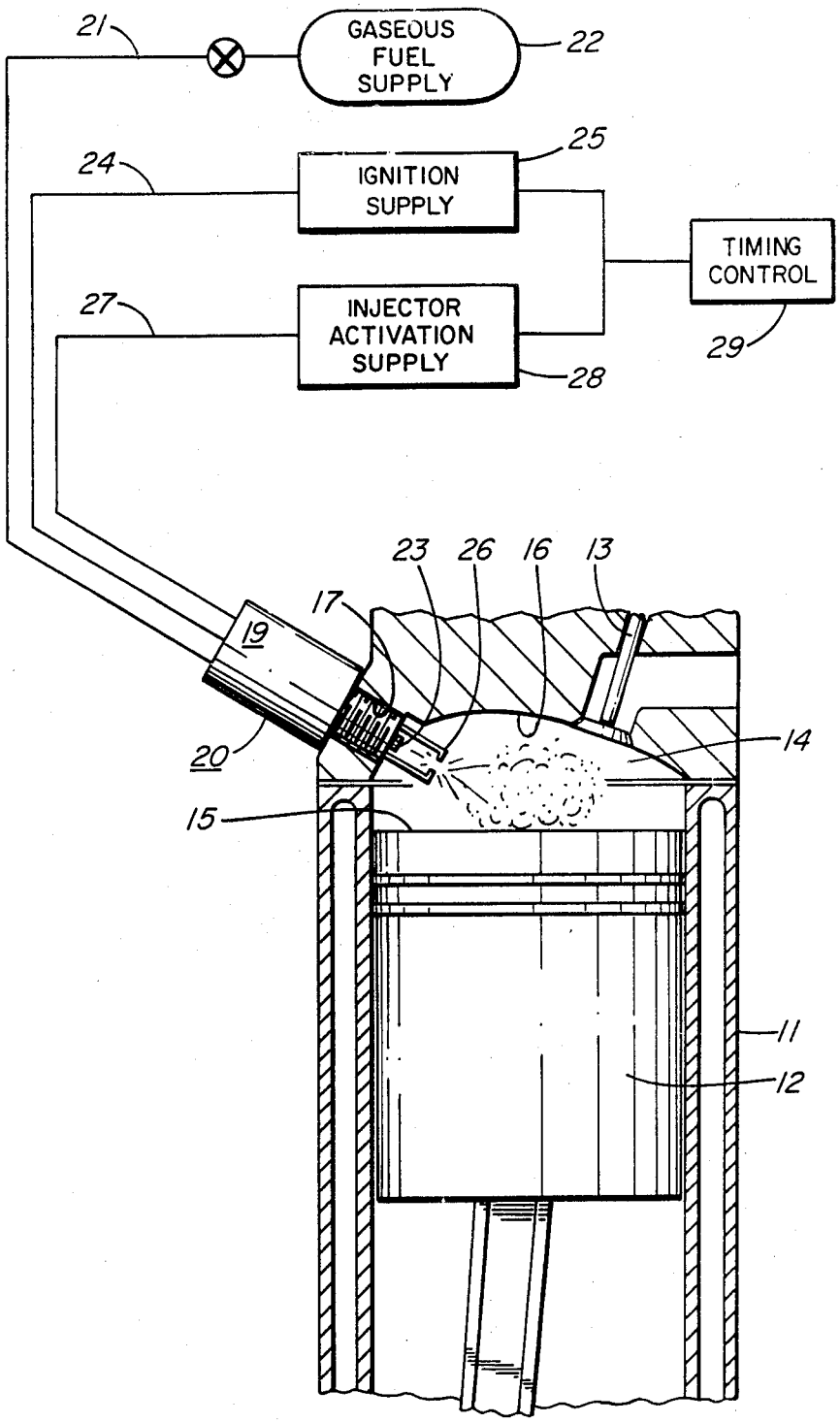
21
GASEOUS FUEL SUPPLY
22
24
IGNITION SUPPLY
25
TIMING CONTROL
27
INJECTOR ACTIVATION SUPPLY
28
29
23
26
16
13
17
19
20
14
15
11
12

IGNITION SOURCE FOR INTERNAL COMBUSTION ENGINE

BACKGROUND OF THE INVENTION (i) Field of the Invention

This invention relates to an ignition source for internal combustion engines.

(ii) Description of the Prior Art

The internal combustion engine is required to operate and to burn fuel efficiently over a wide range of speed and load requirements. This is normally achieved by using a rich mixture which burns evenly during the power cycle. Although a rich mixture gives the engine good performance characteristics it is wasteful of fuel and produces a high level of pollutants. A mixture which provides sufficient air to consume all of the fuel charge is too lean for optimum performance and this is particularly true of slow burning fuels, e.g., methane (natural gas).

Research has been progressing to find a means of igniting lean mixtures in such a way that the burn can be completed evenly and quickly.

One method which has been proposed is typified in Canadian Pat. No. 429,758 which involved swirling air around the interior of the engine combustion chamber during the piston compression stroke at a controlled rate with respect to the engine speed. Fuel is then injected under pressure into the air charge during each cycle of operation of the engine. During each cycle of engine operation, a patch of combustible mixture is progressively formed and consumed in a localized area in the combustion chamber. As a result, it was alleged that little or no combustible "end" gases were permitted to exist, and that "ping" or "knock" was inhibited even with fuels with low anti-knock value at high compression rates.

Barber, Canadian Pat. No. 565,196 issued Oct. 28, 1958, provided an improvement by injecting fuel in the form of a spray into the combustion chamber from a particular point and aimed in a particular direction. This was alleged to provide an improved combustion environment.

U.S. Pat. No. 2,184,009 issued Oct. 11, 1949, provided another improvement by the positioning of the ignition means very much closer to the fuel injection means than had been done previously, allegedly resulting in the ignition of fuel-air mixture sooner, and in the use of a wider range of spray shapes to produce knock-free operation regularly.

Barber, Canadian Pat. No. 588,190 issued Dec. 1, 1959, provided still another improvement by the use of a particularly defined fuel injection means including a nozzle body, an orifice plate with valve seat and a slidable valve for cooperating with the orifice plate to control the fuel flow through the orifice.

Barber et al. Canadian Pat. No. 981,998 issued Jan. 20, 1976, provided an improvement by using a fuel-air charge, which had been premixed in proportions to provide a mixture capable of flame ignition, but incapable of spark ignition. The premixed fuel-air charge was caused to flow rapidly about the combustion chamber in a swirling pattern, and a pilot charge of fuel was injected into the swirling premixed charge, thereby to form a spark-ignitable fuel-air mixing surrounding the spark plug. Ignition of the spark-ignitable mixture by the spark plug establishes a flame further to ignite the fuel-air mixture swirling within the combustion chamber.

Thus, these Barber patents embody the single concept of non-turbulent liquid pilot injection directly into the combustion chamber in the vicinity of the spark. Turbulence is generated separately by the intake stroke. The Barber patents require extensive combustion chamber modifications and are intended for liquid fuels.

Other proposals have been made to improve the combustion efficiency through the generation of turbulent conditions within the engine cylinder In Canadian Pat. No. 848,750 issued Aug. 11, 1970 to Daimler-Benz, an eddying or whirling movement is imparted to the inflowing fuel-air about an axis extending in the longitudinal direction of the cylinder. That eddy or vortex is then displaced in the compression top-dead-centre position into the piston combustion chamber. This was alleged to provide an extension of the knocking limit by about two compression units. This was alleged to provide somewhat lower fuel consumption and to use a less expensive fuel of a lower octane ratio at the usual compression ratio heretofore common.

Canadian Pat. No. 869,305 issued Apr. 27, 1971 to American Gas Association, the turbulent conditions are embodied in a scavenging air flow coupled with a predetermined position of the glow plug in the combustion chamber.

Canadian Pat. No. 887,977 issued Dec. 14, 1971 to Dynatech Corporation, involves the jetting of hot gas into the cylinder to penetrate and ignite the fuel-air mixture.

U.S. Pat. No. 3,107,658 issued Oct. 22, 1963 to S. Meurer provides for injecting fuel onto the wall of the cylinder, and then forming a unidirectional air swirl therein to mix air with the fuel and means to inject particles of fuel towards the igniting device.

U.S. Pat. No. 3,534,714 issued Oct. 20, 1970 to A. Urlaub provides a fuel injection nozzle means, an intensive air swirl generating means and an anode electrode, with the wall of the cylinder forming the cathode.

U.S. Pat. No. 4,133,322 issued Jan. 9, 1979 to Mitsubishi provides for the injection of air towards the spark gap to create a swirl or turbulence to increase combustibility.

U.S. Pat. No. 4,176,649 issued Dec. 4, 1979 to Toyota provides for compressing the air-fuel mixture in the cylinder to cause turbulence and swirling in the auxiliary section of the combustion chamber to control the rate of combustion.

Thus, in these prior patents as well, extensive combustion chamber modifications are necessary.

Other proposals which have been made are those which involve a stratified fuel charge or a pilot flame.

Thus, Canadian Pat. No. 537,727 issued Mar. 5, 1957 to Daimler-Benz provides fuel injection system which injects a compact jet of fuel into the pre-combustion chamber.

Canadian Pat. No. 994,627 issued Aug. 10, 1976 to Honda provides a main combustion chamber and an auxiliary chamber. The rich mixture fed to the auxiliary chamber is ignited by a spark plug and this causes the lean mixture in the main combustion chamber to be ignited.

Canadian Pat. No. 1,020,423 issued Nov. 8, 1977 to Honda provides an improvement on Canadian Pat. No. 994,627 by recycling exhaust gases through the auxiliary combustion chamber to reduce $NO_x$ fumes.

Canadian Pat. No. 1,092,458 issued Dec. 30, 1980 to Fiat provides an insert in the cylinder providing an ignition pre-chamber to ignite fuel injected into the cylinder which has been finely atomized by impingement on an impingement surface.

Kamiya, U.S. Pat. No. 4,091,774 patented May 30, 1978, provides a stratified combustion-type engine in which an injection nozzle injects auxiliary fuel towards the combustion chamber. An open pre-combustion chamber equipped with a spark plug locally holds and vaporizes the auxiliary fuel to increase its burning rate while a lean mixture also admitted to the combustion chamber is ignited by the flame of the rich mixture.

Thus, these proposals provide a liquid fuel pilot injection system which relies on combustion to generate turbulence and flame for further combustion. While most proposals are "add on" devices, they do require additional pre-combustion chambers and are designed for use with liquid fuels.

Other patents purported to provide improved combustion by providing spark plugs having corona discharge or high energy spark characteristics. Among them are Canadian Pat. No. 1,044,973 issued Dec. 12, 1978 to Tokai TRW & Co. Ltd.; U.S. Pat. No. 4,041,922 issued Aug. 16, 1977 to Tokai TRW & Co. Ltd.; U.S. Pat. No. 4,124,003 issued Nov. 7, 1978 to Tokai TRW & Co. Ltd.; U.S. Pat. No. 4,219,001 issued Aug. 26, 1980 to Tokai TRW & Co. Ltd.; and U.S. Pat. No. 4,317,068 issued Feb. 23, 1982 to Combustion Electromagnetics Inc.

Plasma jet ignition is one method which has been developed in an attempt to achieve this goal. One example of such proposal is in U.S. Pat. No. 4,164,912 issued Aug. 21, 1979 to R. R. C. Baylor. A comparatively large amount of electrical energy is released into a cavity causing a jet of highly excited gas to be shot into the cylinder. This plasma plume causes ignition of a lean mixture at many sites and gives a satisfactory power burn. Unfortunately the energy consumption and electrode wear of this system is prohibitive and until now these drawbacks had not been resolved.

SUMMARY OF THE INVENTION (i) Aims of the Invention

Objects of this invention include the provision of an ignition source in which:

1. the ignition is distributed throughout a large volume of the combustion chamber, and hence the ignition delay and burn time are shortened for lean mixtures;
2. ignition is attained independent of how little fuel there is in the combustion chamber;
3. high level, small scale turbulence are produced which predominate over turbulence present in the main chamber;
4. the fuel in the combustion chamber need not be the same as the injected pilot fuel; and
5. the pilot fuel is in the order of 1% of the main fuel charge.

Another object of this invention is to provide such a system which is basically an "add on" feature requiring, in principal, no modification to the combustion chamber (i.e., no prechamber is required).

A further object of this invention is the provision of a mechanical jet ignition which exhibits the advantages of plasma jet ignition without the excessive energy consumption and associated electrode wear, along with the advantages of a stratified charge engine without extensive modifications to the cylinder head and intake systems.

(ii) Statement of Invention

By this invention, an improved ignition system is provided for an internal combustion engine having a combustion chamber and means for feeding an ambient fuel-air combustible mixture to the combustion chamber by a conventional carburetor system, by a conventional fuel injection system or by a conventional gas mixing system, the ignition system comprising an injection electrode assembly consisting essentially of: (i) an injector nozzle provided with a fast-acting valve which opens in 20—20 microseconds; (ii) a source of gaseous fuel which is gaseous at normal room temperature and at five to six times normal atmospheric pressure; (iii) means for feeding the gaseous fuel from the source to the injector nozzle; (iv) means for actuating the fast-acting valve; (v) a spark electrode for providing a spark gap, the spark electrode projecting a predetermined distance into the combustion chamber so that the axis of the injector nozzle passes through the spark gap, whereby a puff in the form of a short, abrupt blast of the gaseous fuel is expelled across the spark to produce a well-defined turbulent plume of injected gaseous fuel, mixed with ambient fuel-air combustible mixture in the combustion chamber; (vi) means for supplying electrical energy to the spark electrodes; and (vii) means for controlling the time and duration of the electric spark and the fast-acting valve actuating means to control the length of time it takes to open the fast-acting valve and the length of time the fast-acting valve remains open so that the electric spark occurs after an appropriate predetermined time after the opening of the fast-acting valve, when the turbulent plume passes in the vicinity of the spark electrode, so that the ambient fuel-air mixture and the injected gaseous fuel in the combustion chamber are simultaneously ignited.

(iii) Other Features of the Invention

By one feature of this invention, the gaseous fuel supply constitutes a minor proportion of the combustible fuel to the engine.

By another feature of this invention, the gaseous fuel constitutes about 1% of such fuel.

By yet another feature of this invention, the gaseous fuel is a gaseous hydrocarbon at about 5–6 atmospheres pressure.

By still another feature of this invention, the gaseous fuel is hydrogen at about 5–6 atmospheres pressure.

By a further feature of this invention, the valve is an electrically controlled fuel injection valve.

By another feature of this invention, the valve is opened within an order of magnitude of microseconds for a length of time of the order of about a hundred microseconds.

By a further feature of this invention, the spark electrode projects from the nozzle by a distance of the order of about 1 cm.

By other features of this invention, the main fuel-air mixture is fed by a carburetor or the main fuel-air mixture is fed by a fuel injection system.

(iv) Generalized Description of the Invention

In other words, by this invention, a high speed injector is used electromechanically to create a turbulent gaseous fuel "puff" which is directed through a pair of electrodes. The electrodes may be constructed integrally within the injector or mounted externally to it. As the rich fuel puff expands, combining with the leaner ambient mixture, it reaches an optimum composition for rapid combustion. A low energy spark across the electrodes causes ignition at that time to provide a pilot flame.

A fast-acting gas valve produces a well-defined turbulent jet of gaseous fuel which entrains the ambient fuel-air mixture. This mixing produces a highly turbulent stratified charge in the vicinity of a conventional low energy electrical discharge. The mixture strength of this charge can be optimized by varying the time between the gas valve opening and the spark.

It will be seen that the present invention differs over the teachings of some of the prior art patents, e.g., the Barber patents, in embodying gaseous injection of a turbulent pilot jet. Engine generated large scale turbulence is not required. It is believed that the small scale, high intensity turbulence produced by the jet is more favourable for efficient combustion.

The present invention is also different from other of the prior art patents, e.g., the Kamiya patent, in that the turbulence level and scale are considerably different.

BRIEF DESCRIPTION OF THE DRAWINGS

In the accompanying drawing, the single FIGURE is a schematic drawing of the ignition system of broad aspects of this invention.

DESCRIPTION OF THE PREFERRED EMBODIMENT

As seen in the drawing, the cylinder 11 is provided with a conventional piston 12 and an inlet valve 13 and outlet valve (not shown). Fuel-air combustible mixtures are fed through valve 13 either by a conventional carburetor system or by a conventional fuel injection system.

An upper combustion chamber 14 is provided between the top 15 of the piston 12 at its upper stroke and the roof 16 of the cylinder 11. An internally tapped entry 17 is provided for the injector electrode assembly 19. Conventionally this would take the form of a spark plug, but the ignition system of the present invention is substituted therefor.

In the present invention, the improved ignition system takes the form of an injector/electrode assembly 19, including: a main chamber 20; a line 21 for a source of gaseous fuel from a gaseous fuel supply 22 to an injection nozzle having a fast-acting valve 23 controlled by injector actuation supply 28. A timing control 29 controls the ignition system which is constituted by a spark gap 26 provided with electrical ignition energy from ignition supply 25.

While the structure of the injector nozzle 23 and the circuitry of the ignition supply 25, the injection activation supply 28 and timing control 29 have not been described, it is well known in the art of electronic fuel control systems that computing means may control an injector valve means, as described in U.S. Pat. No. 3,967,598 issued July 6, 1976 to The Bendix Corporation. A type of fuel injector valve is disclosed in Canadian Pat. No. 489,330 issued Jan. 6, 1953 to P. J. Kaniut. Control of fuel injection systems is described in U.S. Pat. No. 4,142,683 issued Mar. 6, 1979 to The Bendix Corporation. The structure and operation of the injector nozzle, injector nozzle valves and the ignition supply, injector activation supply and timing control are described in the following Bosch GmbH Canadian patents:

956,192 dated Oct. 15, 1974
961,719 dated Jan. 28, 1975
997,234 dated Sept. 21, 1976
997,235 dated Sept. 21, 1976
891,730 dated Jan. 25, 1972
893,343 dated Feb. 15, 1972
and 930,848 dated July 24, 1973.

OPERATION OF THE PREFERRED EMBODIMENT

As the gaseous fuel is injected through the injector nozzle which is controlled to open during a period of time of the order of microseconds, e.g., 10–20 for a time of the order of a hundred microseconds, a high turbulent "puff" is created which can easily be ignited by the electrodes which are timed to spark at the precise time.

Measurements comparing the dynamics of the mechanically created puff with those of the plasma jet show a good correlation. The plots taken of pressure versus time for ignition caused by either system are also essentially the same.

Combustion bomb tests have shown that the new igniter will fire extremely lean mixtures which cannot be ignited by conventional means and will cause all mixtures to burn more rapidly than with a regular ignition system. The former of these characteristics is exhibited by the stratified charge engine and both characteristics by plasma jet ignition systems.

The injection ignition device of one embodiment of this invention has been tested on a single cylinder test engine and has successfully ignited very lean methane/air mixtures. Initial results show a clear improvement of both ignition and combustion of these lean mixtures by comparison with a conventional spark ignition system.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. An improved ignition system for an internal combustion engine having a combustion chamber and means for feeding an ambient fuel-air combustible mixture to said combustion chamber by a conventional fuel injection system or by a conventional gas mixing system, the ignition system comprising an injection electrode assembly consisting essentially of:

(i) an injector nozzle provided with a fast-acting valve opens in 10–20 microseconds;

(ii) a source of gaseous fuel which is gaseous at normal room room temperature and at five to six times normal atmospheric pressure;

(iii) means for feeding the gaseous fuel from the source to the injector nozzle;

(iv) means for actuating said fast-acting valve;

(v) a spark electrode for providing a spark gap, said spark electrode projecting a predetermined distance into said combustion chamber so that the axis of the injector nozzle passes through said spark gap, whereby a puff in the form of a short, abrupt blast of said gaseous fuel is expelled across said spark to produce a well-defined turbulent plume of injected gaseous fuel, mixed with ambient fuel-air combustible mixture in the combustion chamber;

(vi) means for supplying electrical energy to said spark electrode; and (vii) means for controlling the time and duration of the electric spark and said fast-acting valve actuating means to control the length of time it takes to open said fast-acting valve and the length of time said fast-acting valve remains open so that said electric spark occurs after an appropriate predetermined time after the opening of said fast-acting valve, when said turbulent plume passes in the vicinity of said spark electrode, so that said ambient fuel-air mixture and said injected gaseous fuel in the combustion chamber are simultaneously ignited.

2. The ignition system of claim 1 wherein said gaseous fuel constitutes about 1% of said fuel fed to said internal combustion engine.

3. The ignition system of claim 1 wherein said gaseous fuel is a gaseous hydrocarbon fed to said internal combustion engine at 5–6 atmospheres pressure.

4. The ignition system of claim 1 wherein said gaseous fuel is hydrogen fed to said internal combustion engine at 5–6 atmospheres pressure.

5. The ignition system of claim 1 wherein said spark electrode projects from said nozzle by a distance of about 1 cm.

6. The ignition system of claim 1 wherein said valve is an electrically controlled fuel injection valve.

7. The ignition system of claim 6 wherein said fast-acting valve actuation means is controlled to maintain the length of time said valve remains open to be of the order of about one hundred microseconds.

* * * * *